US011225978B2

(12) United States Patent
Merritt et al.

(10) Patent No.: US 11,225,978 B2
(45) Date of Patent: Jan. 18, 2022

(54) MOTOR AND BEARING COOLING PATHS

(71) Applicant: Hamilton Sundstrand Corporation, Charlotte, NC (US)

(72) Inventors: Brent J. Merritt, Southwick, MA (US); Craig M. Beers, Wethersfield, CT (US); John M. Beck, Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 53 days.

(21) Appl. No.: 16/530,497

(22) Filed: Aug. 2, 2019

(65) Prior Publication Data

US 2021/0033112 A1 Feb. 4, 2021

(51) Int. Cl.
*F04D 29/58* (2006.01)

(52) U.S. Cl.
CPC ..... *F04D 29/5806* (2013.01); *F04D 29/584* (2013.01)

(58) Field of Classification Search
CPC ..... F04D 29/5806; F04D 29/584; F04D 29/5846; F04D 29/082; F04D 29/0513; F04D 29/051; F04D 29/056
See application file for complete search history.

(56) References Cited

U.S. PATENT DOCUMENTS 7,394,175 B2 7/2008 McAuliffe et al.
8,863,548 B2 10/2014 Hipsky
2007/0018516 A1* 1/2007 Pal ..... H02K 7/14 310/61
2010/0287958 A1* 11/2010 Telakowski ..... F04D 29/5806 62/56
2011/0255963 A1 10/2011 Kim
2012/0064814 A1* 3/2012 Beers ..... F04D 29/057 454/71
2015/0308456 A1* 10/2015 Thompson ..... H02K 9/00 417/244
2018/0066666 A1 3/2018 Colson et al.

OTHER PUBLICATIONS

The Extended European Search Report for European Patent Application No. 19216333.5 dated Jul. 17, 2020.

* cited by examiner

*Primary Examiner* — Kenneth J Hansen
(74) *Attorney, Agent, or Firm* — Carlson, Gaskey & Olds, P.C.

(57) ABSTRACT

A compressor according to an exemplary embodiment of this disclosure, among other possible things includes, a rotor driven by a shaft and configured to compress air. A motor is drives the shaft. First and second journal bearings facilitate rotation of the shaft. The first journal bearing is located upstream from the motor, and the second journal bearing is located downstream from the motor. A thrust bearing also facilitates rotation of the shaft. The thrust bearing is downstream from the second journal bearing. A tie rod connects the shaft to a motor rotor shaft adjacent the first journal bearing. The tie rod includes an opening which is configured to communicate cooling air from the motor to the rotor. A method for cooling a compressor is also disclosed.

20 Claims, 2 Drawing Sheets

MOTOR AND BEARING COOLING PATHS

BACKGROUND

This application relates to a compressor for an air machine.

Air machines include a turbine and a compressor. Partially compressed air is delivered to the compressor, and the compressor is driven to further compress this air. A motor drives the compressor. This compressed air is passed downstream to drive a turbine, with the turbine in turn helping to drive the compressor as the air expands across the turbine. This expanded air is then utilized for a downstream use, such as cabin air for an aircraft.

Air machines have a shaft which connects the compressor and the turbine. Bearings facilitate rotation of the shaft. Heat accumulates in the copressor as the air machine operates, and in particular, at the bearings and motor.

SUMMARY

A compressor according to an exemplary embodiment of this disclosure, among other possible things includes, a rotor driven by a shaft and configured to compress air. A motor is drives the shaft. First and second journal bearings facilitate rotation of the shaft. The first journal bearing is located upstream from the motor, and the second journal bearing is located downstream from the motor. A thrust bearing also facilitates rotation of the shaft. The thrust bearing is downstream from the second journal bearing. A tie rod connects the shaft to a motor rotor shaft adjacent the first journal bearing. The tie rod includes an opening which is configured to communicate cooling air from the motor to the rotor.

In a further example of the foregoing, the compressor includes a transfer tube. The transfer tube is configured to provide cooling air from a bearing cooling air inlet to the second journal bearing.

In a further example of any of the foregoing, the cooling air travels in the same direction as a direction of airflow through the compressor.

In a further example of any of the foregoing, the compressor includes a seal upstream from the first journal bearing which is configured to direct cooling air from the transfer tube to the first journal bearing.

In a further example of any of the foregoing, a bearing cooling air inlet is in fluid communication with the thrust bearing.

In a further example of any of the foregoing, the thrust bearing includes a thrust shaft and a thrust plate. The thrust shaft includes first and second orifices. The first and second orifices are in fluid communication with a bearing cooling air inlet.

In a further example of any of the foregoing, the second journal bearing is in fluid communication with the second orifice and the thrust bearing is in fluid communication with the first orifice.

In a further example of any of the foregoing, the compressor includes a passage between the motor and the shaft. The passage is in fluid communication with the bearing cooling air inlet via the first and second orifices.

In a further example of any of the foregoing, the bearing cooling stream includes first and second bearing cooling streams. The first bearing cooling stream passes through the second journal bearing and the second bearing cooling stream does not pass through the second journal bearing.

In a further example of any of the foregoing, the compressor includes a seal immediately upstream from the second journal bearing and is configured to direct the first bearing cooling stream to the motor.

In a further example of any of the foregoing, the rotor includes an opening that is configured to communicate the cooling air from the tie rod to an inlet of the compressor.

In a further example of any of the foregoing, a heat shield is located upstream from the motor from the opening in the tie rod and downstream from the rotor.

A method for cooling a compressor according to an exemplary embodiment of this disclosure, among other possible things includes providing a cooling air stream to a thrust bearing and a first journal bearing. The thrust bearing and first journal bearings are configured to facilitate rotation of a shaft in a compressor. A cooling air stream is provided to a rotor of a motor which is configured to rotate the shaft. The cooling air stream is communicated to a rotor of the compressor via an opening in a tie rod connecting the shaft to a motor rotor shaft.

In a further example of the foregoing, a second cooling air stream is provided to a second journal bearing such that that cooling air provided to the second journal bearing does not pass through the first journal bearing.

In a further example of any of the foregoing, the second cooling air stream is provided to the second journal bearing from a bearing cooling air inlet via a transfer tube.

In a further example of any of the foregoing, the second cooling air stream flows through the second journal bearing in the same direction as a direction of airflow through the compressor.

In a further example of any of the foregoing, the method includes communicating the cooling air stream through an opening in a rotor of the compressor.

DETAILED DESCRIPTION

Figure 1:
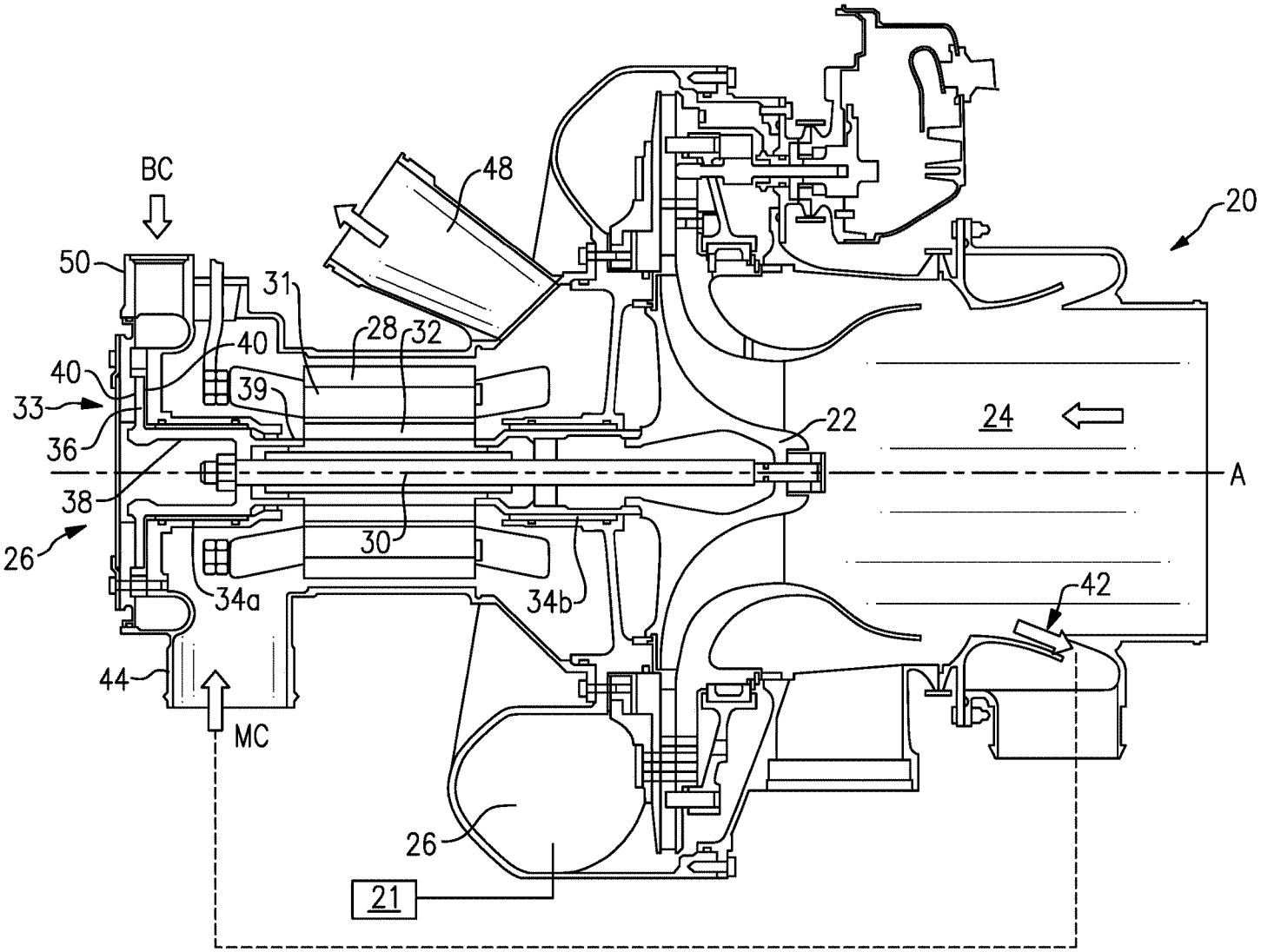
FIG. 1 shows a schematic cross-section of a compressor for an air machine.

FIG. 1 shows a compressor 20 that may be incorporated into a cabin air supply system 21 for supplying air to the cabin of an aircraft. A rotor 22 receives air to be compressed from an inlet 24, and compresses the air to a compressor outlet 26. A motor 28 drives a motor rotor shaft 39 and driveshaft 30 and to rotate the rotor 22. The motor 28 is an electric motor and includes a rotor 31 and a stator 32, as would be known in the art. In FIG. 1, air flows through the compressor from right to left.

A thrust bearing 33 and a journal bearings 34*a*, 34*b* facilitate rotation of the driveshaft 30. The thrust bearing 33 includes a thrust bearing disk 36 which is associated with a thrust shaft 38. The thrust shaft 38 connects to the motor rotor shaft 39. The thrust bearing disk 36 has thrust bearing surfaces 40.

Figure 2:
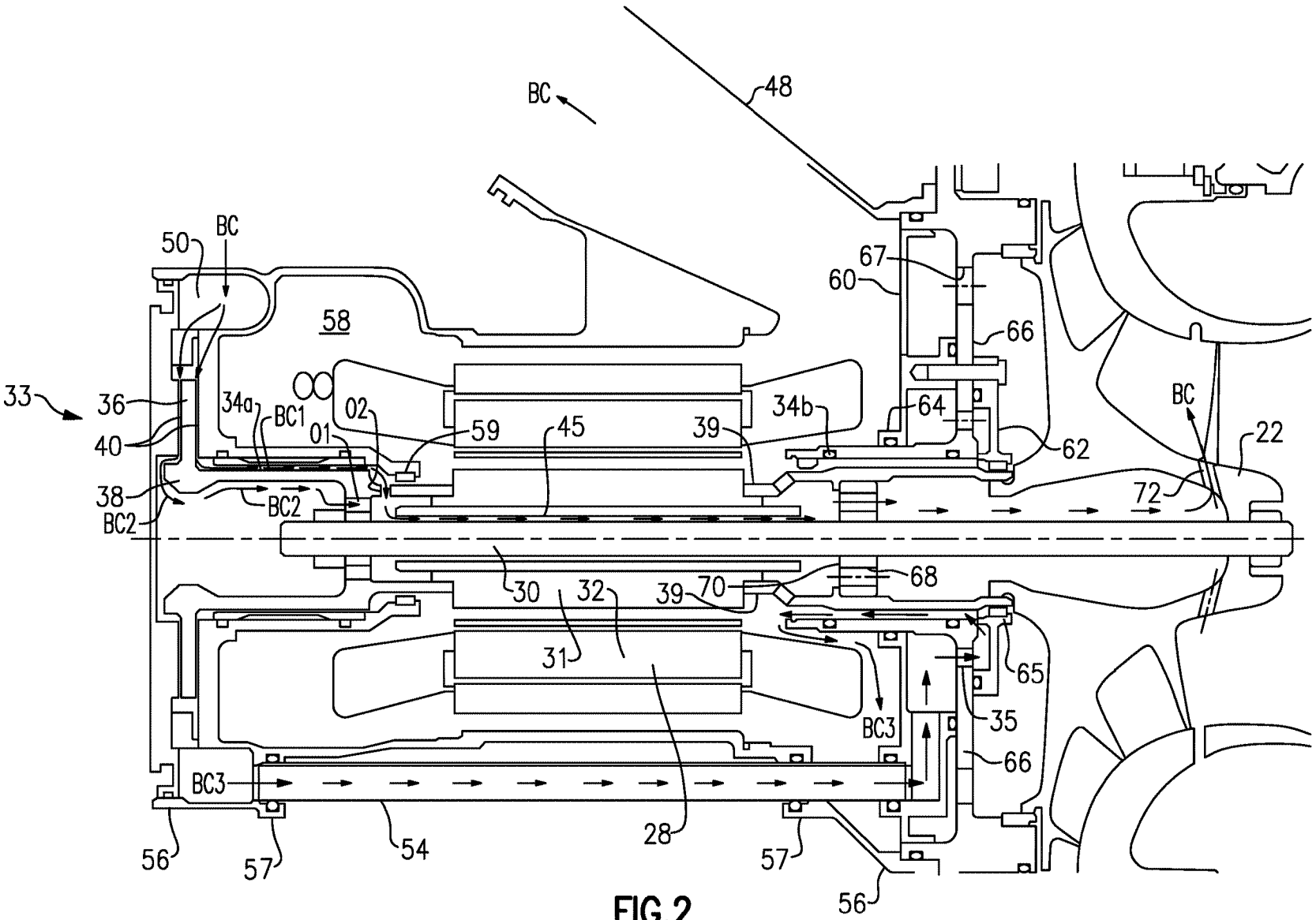
FIG. 2 shows a detail view the cross-section of FIG. 1.

The motor 28, the thrust bearing 33, and the journal bearings 34*a*, 34*b* are cooled with cooling air. FIG. 2 schematically shows a detail view of the motor 28 and bearing 33, 34*a*, 34*b*.

A motor cooling stream MC is drawn from the compressor inlet 20 at 42 and provided to a motor cooling inlet 44. The motor cooling stream MC ultimately exits the compressor 20 via a cooing air outlet 48. In one example, the outlet 48 ducts to ram (e.g., ambient) air. A bearing cooling stream BC is drawn from downstream of the compressor outlet 26 and provided to a bearing cooling inlet 50. In one example, a heat exchanger (not shown) is upstream from the bearing cooling inlet 50 and downstream from the compressor outlet 26, and cools air in the bearing cooling stream BC.

The bearing cooling stream BC cools both the thrust bearing 33 and the journal bearings 34*a*, 34*b*, and provides cooling to the motor 28, which will be explained in more detail below.

The bearing cooling stream BC is split into two bearing cooling streams BC1 and BC2, which pass along both sides of the thrust plate 36 at thrust surfaces 40 to cool the thrust bearing 33. The bearing cooling streams BC1 and BC2 continue along either side of the thrust shaft 38.

Orifices O1 and O2 are formed in the thrust shaft 38. The orifice O1 is oriented generally parallel to an axis A of the shaft 30 while the orifice O2 is oriented generally perpendicular to an axis A of the shaft 30. That is, the orifices O1, O2 are oriented generally perpendicular to one another. The first bearing cooling stream B1 passes through the journal bearing 34*a* and then through the orifice O2. The second bearing cooling stream BC2 passes through the orifice O1. The first bearing cooling stream BC1 then joins the second bearing cooling stream BC2 and both streams pass along the inside diameter of the motor 28, via a passage 45 adjacent the shaft 30, providing cooling to the motor 28 and/or shaft 30. The bearing cooling streams BC1, BC2 then pass through an opening 68 in a tie rod 70, which is adjacent the journal bearing 34*b*. The tie rod 70 connects the motor rotor shaft 39 to the driveshaft 30. The bearing cooling streams BC1, BC2 then pass through an opening 72 in a compressor rotor 22. The opening 72 is at an upstream end of the rotor 22, adjacent the compressor inlet 24. The bearing cooling streams BC1, BC2 then mix with air in the compressor inlet 24, increasing the amount of air in the compressor inlet 24, thereby increasing the amount of air available for being drawn for the motor cooling stream MC and bearing cooling stream BC.

A third bearing cooling stream BC3 is also provided from the bearing cooling air inlet 50 to a transfer tube 54. The transfer tube 54 communicates the bearing cooling stream BC3 to the journal bearing 34*b*. The transfer tube 54 is attached to a housing 56 of the motor 28 via bosses 57.

Bearing cooling stream BC3 is provided to the journal bearing 34*b* via an opening 35 in a bearing support 66 (discussed more below) and passes through the journal bearing 34*b* in the same direction as the direction of airflow through the compressor 20. The third bearing cooling stream BC3 does not pass through the thrust bearing 33 or journal bearing 34*a*. Accordingly, the third bearing cooling stream BC3 is relatively cool compared to the first and second bearing cooling streams BC1, BC2 at the orifice 03. Therefore, the third bearing cooling stream BC3 provides improved cooling to the journal bearing 34*b*as compared to a cooling stream that has passed through the thrust bearing 33 and/or journal bearing 34*a*. The third bearing cooling stream BC3 ultimately exits the compressor 20 via cooling air outlet 48.

A seal 59, such as a labyrinth seal (though other types of seals are contemplated), is arranged immediately upstream from the journal bearing 34*a* and downstream from the motor 28. The seal 59 prevents the first bearing cooling stream BC1 from entering a cavity 58 between the thrust bearing 33 and the motor 28. Thus, the first bearing cooling stream BC1 is directed into the orifice O2 and then into the motor 28 (as discussed above) by the seal 59. Air in the cavity 58 thus stays cool relative to the temperature of air in the first bearing cooling stream BC1, and provides thermal insulation for the motor 28 and other compressor 20 components from the relatively hot first bearing cooling stream BC1. Additionally, the seal 59 prevents loss of pressure in the first bearing cooling stream BC1 as it travels through journal bearing 34*a*. In other words, the pressure drop of the first bearing cooling stream BC1 across the journal bearing 34*a* is relatively low. This improves the lifetime and reliability of the journal bearing 34*a*.

A heat shield 60 and seal plate 62 are provided upstream from the motor 28 and adjacent the journal bearing 34*b*. The seal plate 62 includes a seal 64 such as a vespel seal or o-seal, though other types of seals are contemplated. In one example, seal 64 is a static o-seal. Seal 64 prevents high-pressure air in the third bearing cooling stream BC3 from leaking into the outlet 48 prior to entering the journal bearing 34*b*. In other words, the seal 64 helps direct bearing cooling stream BC3 into the journal bearing 34*b*. The seal plate 62 also includes a seal 65 such as a labyrinth seal (though other types of seals are contemplated) immediately downstream from the journal bearing 34*b*. As with the seal 59 adjacent the journal bearing 34*a*, the seals 64, 65 adjacent the journal bearing 34*b* maintain pressure in the journal bearing 34*b* to minimize pressure drop across the journal bearing 34*b*, which improves the lifetime and reliability of the journal bearing 34*b*.

The heat shield 60 and seal 64 are downstream from a bearing support 66, while the seal plate 62 and seal 65 are upstream of the bearing support 66. The bearing support in this example supports the journal bearing 34*b*. In some examples, the bearing support 66 includes an opening 67 through which leaked hot, high pressure air within the compressor can flow towards the outlet 48. The heat shield 60 thermally insulates the motor 28 (and in particular, the motor stator 31) and journal bearing 34*b* from the hot air.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a rotor driven by a shaft and configured to compress air;

a motor for driving the shaft;

first and second journal bearings for facilitating rotation of the shaft, wherein the first journal bearing is aft from the motor and the second journal bearing is forward from the motor with respect to a central axis of the compressor;

a thrust bearing for facilitating rotation of the shaft, the thrust bearing arranged forward from the second journal bearing;

a tie rod connecting the shaft to a motor rotor shaft adjacent the first journal bearing, wherein the tie rod includes an opening configured to communicate cooling air from the motor to the rotor and;

first and second bearing cooling streams wherein the first bearing cooling stream passes from a bearing cooling air inlet through the second journal bearing and the second bearing cooling stream passes from the bearing cooling air inlet through the first journal bearing and does not pass through the second journal bearing.

2. The compressor of claim 1, further comprising a transfer tube in the second bearing cooling stream, the transfer tube configured to provide cooling air from the bearing cooling air inlet to the first journal bearing.

3. The compressor of claim 2, wherein the cooling air travels in a direction of airflow through the compressor.

4. The compressor of claim 2, further comprising a seal aft from the first journal bearing configured to direct cooling air from the transfer tube to the first journal bearing.

5. The compressor of claim 2, wherein the transfer tube is at least partially external to a housing of the motor.

6. The compressor of claim 1, wherein the bearing cooling air inlet is in fluid communication with the thrust bearing.

7. The compressor of claim 1, further comprising a seal aft from the second journal bearing and configured to direct the first bearing cooling stream to the motor.

8. The compressor of claim 1, wherein the rotor includes an opening configured to communicate the cooling air from the tie rod to an inlet of the compressor.

9. The compressor of claim 8, further comprising a heat shield aft from the motor and forward from the rotor.

10. The compressor of claim 1, wherein the second bearing cooling stream passes through the first journal bearing in a direction that is opposite a direction of airflow through the compressor.

11. The compressor of claim 1, wherein the second bearing cooling stream passes to the first journal bearing via an opening in a bearing support, the bearing support configured to support the first journal bearing.

12. A method for cooling a compressor, comprising:

providing a first cooling air stream to a thrust bearing and a forward journal bearing from a cooling air inlet, the thrust bearing and the forward journal bearing configured to facilitate rotation of a shaft in the compressor;

providing the first cooling air stream to a rotor of a motor configured to rotate the shaft;

communicating the first cooling air stream to a rotor of the compressor via an opening in a tie rod connecting the shaft to a motor rotor shaft; and providing a second cooling air stream to an aft journal bearing from the cooling air inlet, wherein the forward journal bearing is forward of the motor and the aft journal bearing is aft of the motor, and such that that second cooling air stream provided to the aft journal bearing does not pass through the forward journal bearing.

13. The method of claim 12, wherein the second cooling air stream is provided to the aft journal bearing from the second cooling air inlet via a transfer tube.

14. The method of claim 13, wherein the second cooling air stream flows through the aft journal bearing in a direction opposite a direction of airflow through the compressor.

15. The method of claim 12, further comprising communicating the first cooling air stream through an opening in the rotor of the compressor.

16. A compressor comprising:

a rotor driven by a shaft and configured to compress air;

a motor for driving the shaft;

first and second journal bearings for facilitating rotation of the shaft, wherein the first journal bearing is aft from the motor and the second journal bearing is forward from the motor with respect to a central axis of the compressor;

a thrust bearing for facilitating rotation of the shaft, the thrust bearing arranged forward from the second journal bearing;

a tie rod connecting the shaft to a motor rotor shaft adjacent the first journal bearing, wherein the tie rod includes an opening configured to communicate cooling air from the motor to the rotor; and a bearing cooling air inlet in fluid communication with the thrust bearing, wherein the thrust bearing includes a thrust shaft and a thrust plate, the thrust shaft including first and second orifices, wherein the first and second orifices are in fluid communication with the bearing cooling air inlet.

17. The compressor of claim 16, wherein the second journal bearing is in fluid communication with the second orifice and wherein the thrust bearing is in fluid communication with the first orifice.

18. The compressor of claim 16, further comprising a passage between the motor and the shaft, wherein the passage is in fluid communication with the bearing cooling air inlet via the first and second orifices.

19. The compressor of claim 16, wherein the bearing cooling air inlet is in fluid communication with the first journal bearing and is not in fluid communication with the second journal bearing.

20. The compressor of claim 19, wherein the second cooling air inlet is in fluid communication with the first journal bearing via a transfer tube.

* * * * *